US006290075B1

(12) United States Patent
Cheimets et al.

(10) Patent No.: US 6,290,075 B1
(45) Date of Patent: Sep. 18, 2001

(54) DETACHABLE WALL-MOUNTED SHELF

(76) Inventors: Alex Cheimets, 28 School St., Arlington, MA (US) 02476; Antonello Bellocchi, Via Dante 288, Fabriano (An) (IT), 60044

( * ) Notice: Subject to any disclaimer, the term of this patent is extended or adjusted under 35 U.S.C. 154(b) by 0 days.

(21) Appl. No.: 09/608,284

(22) Filed: Jun. 30, 2000

(51) Int. Cl.[7] ..... A47F 5/08

(52) U.S. Cl. ..... 211/90.03; 211/99; 211/183; 248/222.51

(58) Field of Search ..... 211/99, 103, 149, 211/150, 90.02, 90.03, 97, 183; 248/175, 222.51, 235, 239, 240, 249, 250, 223.41, 224.51, 224.61

(56) References Cited

U.S. PATENT DOCUMENTS 1,476,034 * 12/1923 Banks .
2,042,517 * 6/1936 Ellis .
2,379,975 * 7/1945 Luger .
2,473,908 * 6/1949 Rubin .
2,950,541 * 8/1960 Dement .
3,598,064 * 8/1971 Stempel ..... 248/249
4,858,773 * 8/1989 Zimmerman ..... 211/150
4,991,722 * 2/1991 Hight ..... 211/99
5,505,318 * 4/1996 Goff ..... 211/150
5,513,910 * 5/1996 Ellingwood et al. ..... 211/99

* cited by examiner

*Primary Examiner*—Jerry Redman
*Assistant Examiner*—Jennifer E. Novosad
(74) *Attorney, Agent, or Firm*—Morse, Altman & Martin

(57) ABSTRACT

A shelf with a platform and a pair of brackets, whereby the platform has an upper panel and a lower panel at right angles. The upper panel has coaxial trunnions that fit into groove in the brackets. The groove has a vertical back wall, a shaped front wall, an opening in the top of the bracket, an upper pocket in the front wall, and a lower trough where the front and back walls meet at the bottom of the groove. The pocket and trough are connected by a 45° slope. The platform has a down position maintained by gravity where the upper panel is horizontal. The trunnion resides in the groove pocket and the lower panel abuts a vertical retaining wall that is parallel to the vertical back wall of groove. The platform has an up position maintained by gravity where the lower panel is horizontal. The trunnion resides in the trough and the upper panel abuts the retaining wall.

6 Claims, 6 Drawing Sheets

DETACHABLE WALL-MOUNTED SHELF

BACKGROUND OF THE INVENTION

1. Field of the Invention

The present invention relates to shelves, more particularly, to wall-mounted shelves that can detach from the wall and rotate out of the way when not needed.

2. The Prior Art

A shelf is a horizontal platform that is mounted to a wall and used for holding items. One particular use for a shelf is as a warming shelf mounted to the wall behind and above a range stovetop and beneath the range hood. As the name implies, cooked food items are placed on the warming shelf to keep them warm prior to serving. The rising heat from the range aids in keeping the food items warm. Some range hoods have one or more heat lamps directed downwardly to aid in keeping the food items warm. The warming shelf platform is typically a wire frame, rather than a solid sheet, so that rising heat reaches the items resting on top.

The warming shelf is typically pivotally mounted to the wall so that it can be rotated to an up position that is out of the way when not in use. A pair of brackets with a hole permanently mount to the wall and the shelf platform has a shaft that fits into the hole so that the shaft rotates. A clip may hold the platform in the up position so it does not fall open inadvertently.

The warming shelf may be either permanently or removably attached to the wall. The permanent attachment has the least flexibility. The warming shelf must be cleaned in place by hand, forcing a person to lean over the stovetop. It also hampers cleaning of the wall in the area around the warming shelf. A portion of a popular pivotally and permanently mounted shelf is shown in FIGS. 2 and 3. The bracket 100 has a closed slot 102 into which the end of the shaft 104 fits. In the down position, shown in FIG. 2, the shaft 104 is at the top 106 of the slot 102 and the platform 108 rests on a pedestal 110 on the inside surface of the bracket 100. In the up position, shown in FIG. 3, the shaft 104 is at the bottom 112 of the slot 102 and the platform 108 is straddled by two bracket surfaces 114 to hold the platform 108 upright.

Some pivotally mounted warming shelves are removable at the pivot. In one design, the wall-mounted bracket has a shallow hemispherical indentation and the platform has a small round nub. The nub snaps into the indentation. The nub must be small so that it can be snapped into the indentation relatively easily. Consequently, the spacing between the two brackets is critical. If the brackets are not spaced properly or are not mounted securely, the platform will not be held securely. Even relatively lightweight items will cause the bracket to fail to hold the platform.

In another removable design, each bracket has a vertical slot, open at the top of the bracket and rounded at the bottom. The ends of the platform shaft are dropped into the slots to the bottom, where the shaft rotates. A clip is needed to hold the platform in the up position and another clip is typically used to hold the platform in the correct down position.

SUMMARY OF THE INVENTION

An object of the present invention is to provide a shelf that can be rotated easily between secure open and closed positions.

Another object is to provide a shelf that can be easily detached from the wall.

The shelf of the present invention has two components, a platform and a pair of brackets. The preferred platform has an upper panel and a lower panel at right angles to each other. The panels may be any size, or may be merely legs without a surface for items, as long as they perform as described below. Each panel is composed of thinner inner bars within a frame of heavier outer bars. The panels may be a single continuous sheet that is bent at a right angle to form the two panels. The bars are impervious to the heat emanating from a range or from heat lamps in the range hood above. They may be chromed or coated with a non-stick or other material allows the platform to be put in an automatic dishwasher.

The upper panel has a shaft approximately parallel to and a distance from the corner of the panels. The ends of the shaft extend beyond the outer frame to form trunnions. It is also contemplated that the platform only has trunnions without the shaft.

The bracket has a groove for the trunnion and the shape of the groove is a unique aspect of the present invention that differentiates it from the prior art. The bracket has a flat mounting surface for mounting to a wall.

The essence of the groove is an upper pocket and a lower trough connected by a 45° slope. The groove has a front wall, a back wall, and an opening in the top surface of the bracket for reception of the trunnion. The back wall extends vertically to the trough. Optionally, center portion of the back wall extends away from the rear of the bracket to form a dam to prevents inadvertent removal of the trunnion from the groove, as described below.

The front wall starts vertically and bends away from the back wall to horizontal, where it continues to the pocket. The pocket is a bend of approximately 135° back toward the back wall. From the pocket, the front wall slopes downwardly at a 45° angle until it is a distance from the back wall that is slightly larger than the diameter of the trunnion. The front wall then drops vertically to the trough. Thus, the width of the trough is slightly larger than the diameter of the trunnion so that the trunnion will fit into the trough. In order to provide a more secure fit, it is preferred, although not required, that the pocket be a curve and the trough be semicircular, both with a radius slightly larger than the radius of the trunnion.

The platform has a down position where the upper panel is horizontal. In this position, the trunnion resides in the groove pocket and the lower panel abuts a vertical retaining wall that is parallel to the groove back wall. Note that this means that the trunnion is not at the corner of panels, but is on the upper panel at a distance from the corner. The platform is retained in the down position because gravity pushes the trunnion against the front wall but the platform is prevented from moving rearwardly by the lower panel abutting the retaining wall.

In the up position, where the lower panel is horizontal, the trunnion resides in the trough and the upper panel abuts the retaining wall. As with the down position, gravity maintains the platform in the up position. While the weight of the platform causes it to try to rotate to the down position, the lower vertical portion of the front wall prevents the trunnion from exiting the trough. Thus the platform remains securely in the up position.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION

Figure 1:
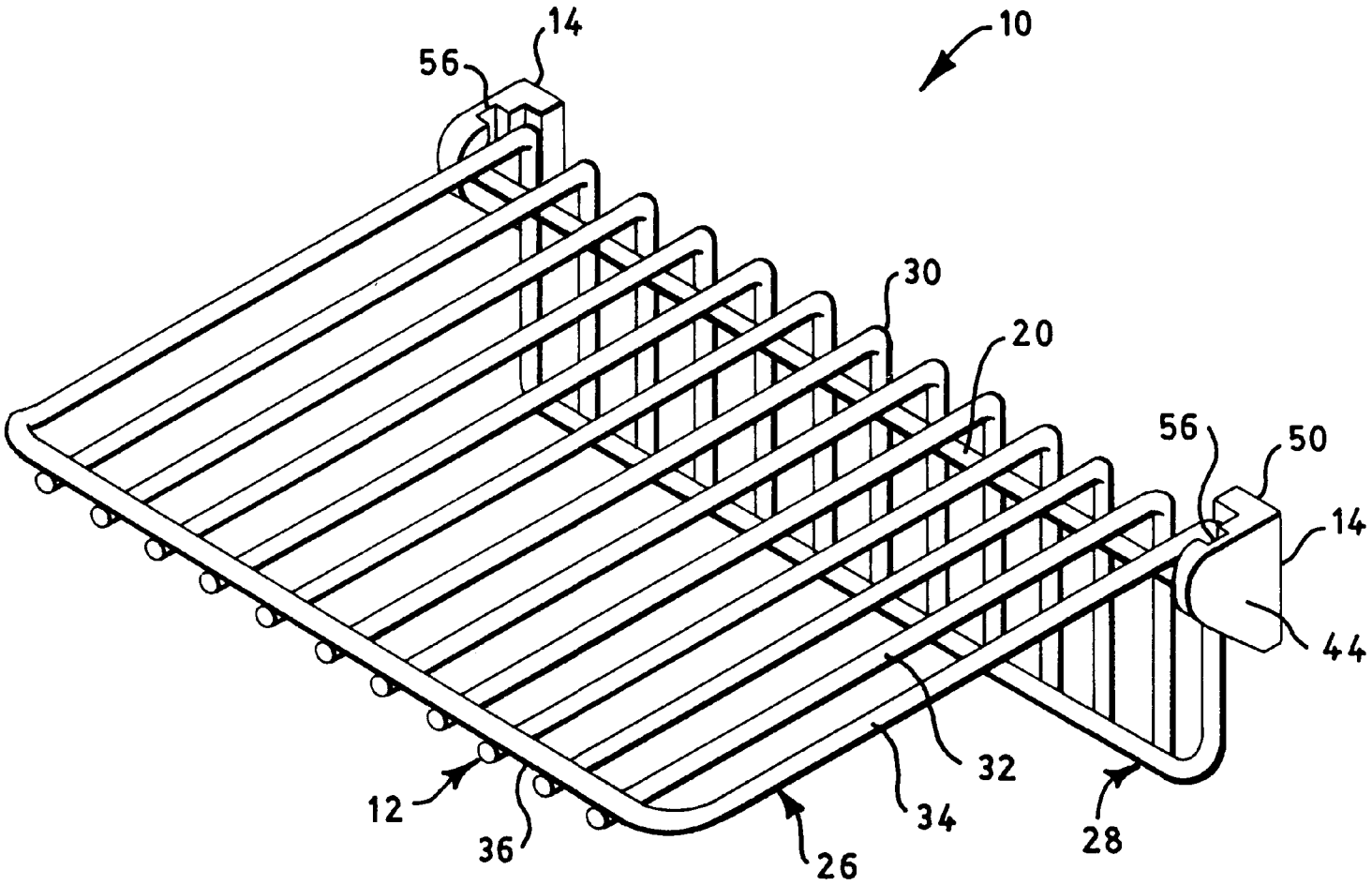
FIG. 1 is an exploded, perspective view the shelf of the present invention.
Figure 2:
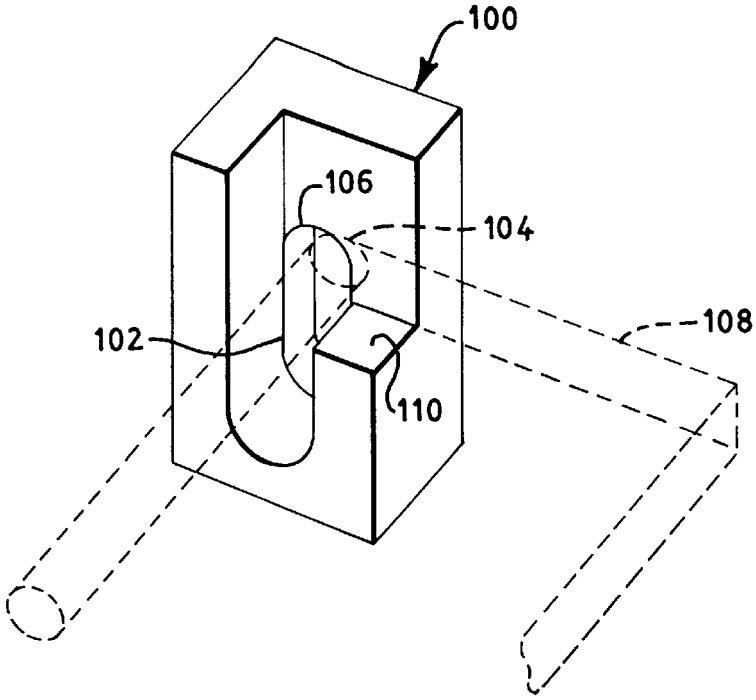
FIG. 2 PRIOR ART
FIG. 2 is a perspective view a portion of a shelf of the prior art with the shelf in the down position.
Figure 3:
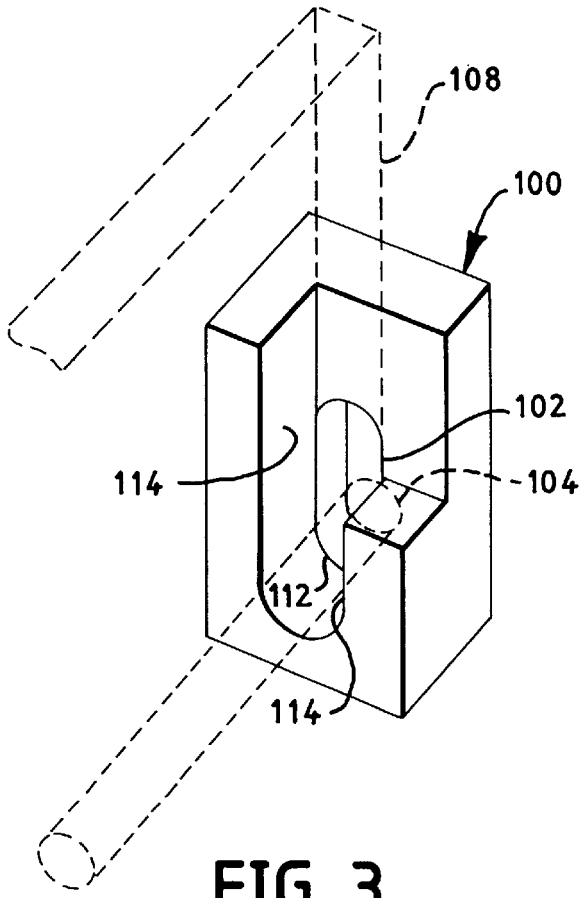
FIG. 3 PRIOR ART
FIG. 3 is a perspective view a portion of a shelf of the prior art with the shelf in the up position.

The shelf 10 of the present invention is shown in FIG. 1. The shelf 10 has two components, a platform 12 and a pair of brackets 14. The platform 12 has a shaft 20, about which the platform 12 rotates. Each end 22 of the shaft 20 resides in a groove 24 within the bracket 14.

Figure 4:
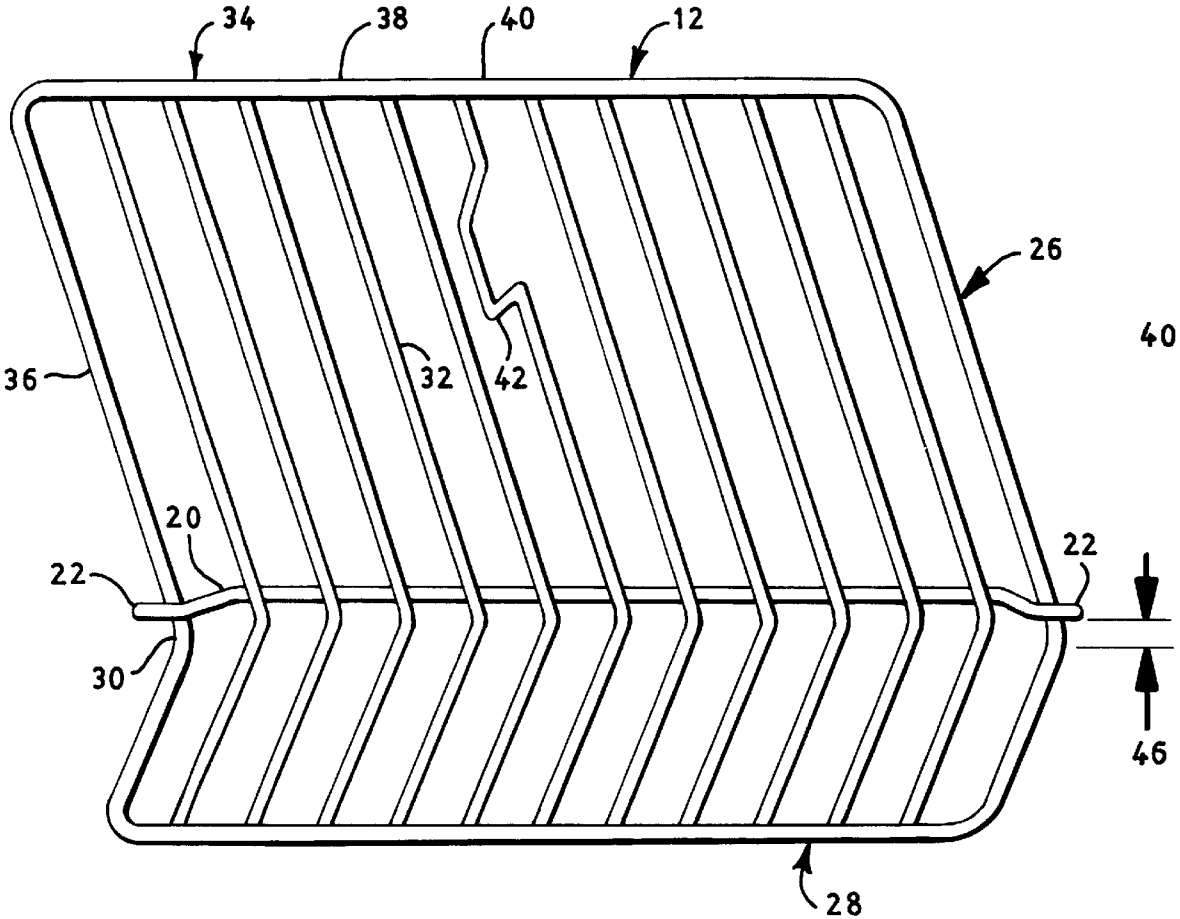
FIG. 4 is a perspective view of the platform of FIG. 1.

The platform 12 of the present invention is shown in FIG. 4. The preferred platform 12 has two panels, an upper panel 26 and a lower panel 28, at right angles to each other at an edge to form a corner 30. Typically, though not necessarily, one panel will be larger than the other panel. It is contemplated that the panels may be any size, as long as they are able to perform the functions described below. It is also contemplated that one of the panels may only consist of short legs without a surface upon which items can be placed, as long as the legs are able to perform the functions described below.

Each panel 26, 28 is composed of a plurality of thin rigid inner bars 32 within an outer frame 34 of heavier outer bars 36, 38. If the panel only has legs and no surface, it will only consist of the parallel outer bars 36. The bars are connected by welding, soldering, epoxy, or any other method that provides a secure and permanent connection. The cross-sectional shape of the bars is not important, but will typically be round. For ease in manufacture, the panels 26, 28 may be a single continuous sheet that is bent at a right angle to form the two panels 26, 28.

Figure 5:
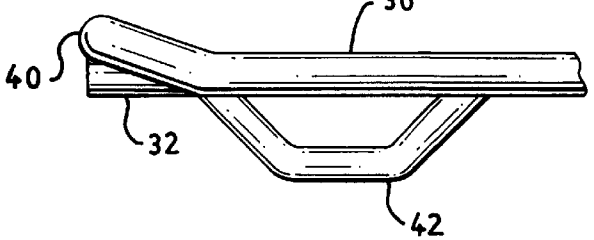
FIG. 5 is a detailed view of a portion of the platform of FIG. 4.

In the present embodiment, the inner bars 32 and the outer bars 36 parallel to the inner bars 32 are generally planar. At the distal edge 40, the outer bars 36 bend slightly out of the plane so that the ends of the inner bars 32 overlap the perpendicular outer bar 38, as shown in FIG. 5. This arrangement has two functions. The first is to provide a larger contact area between the perpendicular outer bar 38 and inner bars 32 for a more secure attachment. The second function depends upon which direction the parallel outer bars 36 are bent. If bent one way, the perpendicular outer bar 36 provides a lip to prevent items resting on the platform 12 from sliding off the platform 12. If bent the other way, the top of the panel is flat to permit it to hold items that will hang over the outer bars 36, 38.

Optionally, one of the inner bars 32 is bent to form a handle 42. The handle 42 provides a means for pulling the upper panel 26 away from the wall 16, as described below.

The bars 32, 36, 38 are composed of a material that is impervious to the heat emanating from the range or from the heat lamps in the range hood above. The bars may be chromed or coated with a non-stick or other material. Preferably, the coating material permits the platform 12 to be washed in an automatic dishwasher.

The shaft 20 is attached to the upper panel 26 approximately parallel to and a distance 46 from the corner 30. The parameters of the location of the shaft 20 are described below with reference to the brackets 14. The ends of the shaft 20 extend beyond the outer frame 32 to form trunnions 22 that sit within the bracket grooves 24. It is also contemplated that the platform 12 only has the trunnions 22 attached to and extending from the outer bars 36. The trunnions 22 have a round cross-section and a smooth outer surface to minimize friction between the shaft 20 and bracket groove 24.

Figure 6:
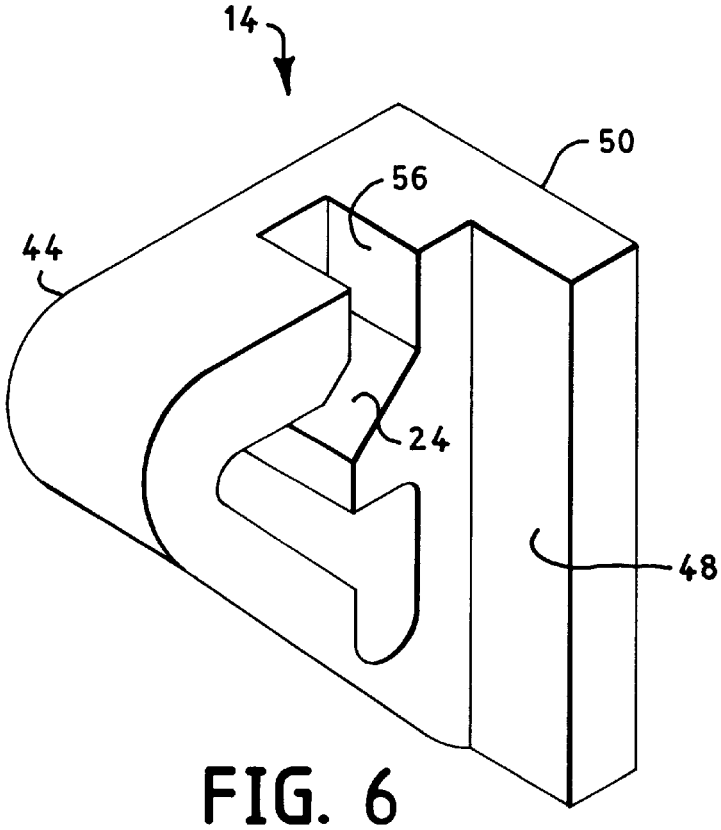
FIG. 6 is a perspective view of one bracket of FIG. 1.
Figure 7:
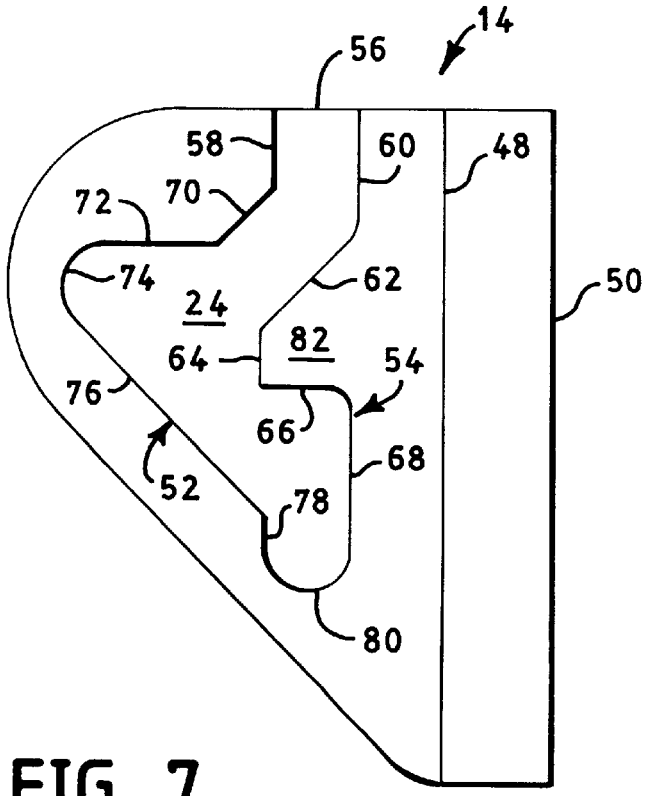
FIG. 7 is a side view of the bracket of FIG. 6.

A unique aspect of the present invention is in the shape of the bracket groove 24, shown in detail in FIGS. 6 and 7. Note that the second bracket of the bracket pair is a mirror image of the bracket shown in the figures.

The bracket 14 has a flat mounting surface 50 for mounting to the wall 16. The manner of mounting is not an aspect of the present invention, but must be robust enough to at least handle any weight reasonably expected to be carried by the platform. Possible mounting methods include adhesives and screws. It is contemplated that the brackets 14 can be mounted to the same wall, in which case the mounting surface is at the rear of the bracket 14, or that the brackets 14 can be mounted to parallel walls, in which case the mounting surface is on the outside surface 44 of the bracket, opposite the groove 24. The bracket has a vertical retaining wall 48, whose function is described below.

The groove 24 has a front wall 52 and a back wall 54. The top of the groove 24 is an opening 56 in the top surface of the bracket 14. The width of the groove 24 at the opening 56 is slightly larger than the diameter of the trunnion 22 so that the trunnion 22 fits into the opening 56. And the distance of the back wall at the opening 60 from the retaining wall 48 is approximately the same as the diameter of the outer bars 36. The groove 24 extends downwardly, as at 58, 60, where turns away from the mounting surface 50 at an approximately 45° angle, as at 62. When the back wall 54 of the groove is approximately aligned with the front wall at the opening 58, the back wall 54 bends downwardly approximately vertically, as at 64. After dropping vertically approximately the diameter of the trunnion 22, the back wall 54 turns horizontally toward the mounting surface 50, as at 66. When it is approximately aligned with the back wall at the opening 60, it turns vertically downward, as at 68. An alternate embodiment of the groove 24 calls for the back wall 54 to be a single vertical wall, that is, without the 45° portion 62, the center vertical portion 64, and the horizontal portion 66. The dam 82 created by these three portions prevents inadvertent removal of the platform 12 from the groove 24, as described below.

Meanwhile, the front wall 52 continues at the 45° angle a short distance, as at 70, where it turns approximately 45° to horizontal. It is not necessary that these two angles be 45°, only that, at the end of the second bend, the front wall is approximately horizontal. The front wall 52 continues horizontally, as at 72, to a pocket 74 that turns approximately 135° downwardly. The front wall 52 extends downwardly and toward the mounting surface 50 at an approximately 45° angle, as at 76, until it is approximately aligned with the front wall at the opening 58. At that point, it bends about 135° downwardly so it is parallel to the back wall 68, as at 78, to the trough 80 of the groove 24. The width of the trough 80, that is, the distance between the front and back walls, is slightly larger than the diameter of the trunnion 22 so that the trunnion will fit into the trough 80. The length of the vertical drop 78 is explained below.

It is preferred that the pocket 74 be a curve with a radius slightly larger than the radius of the trunnion 22 and that the trough 80 be semicircular also with a radius slightly larger than the radius of the trunnion 22. These particular shapes for the pocket 74 and trough 80 are not necessary to the functionality of the present invention, but do provide a smoother operation and more esthetic appearance.

Figure 8:
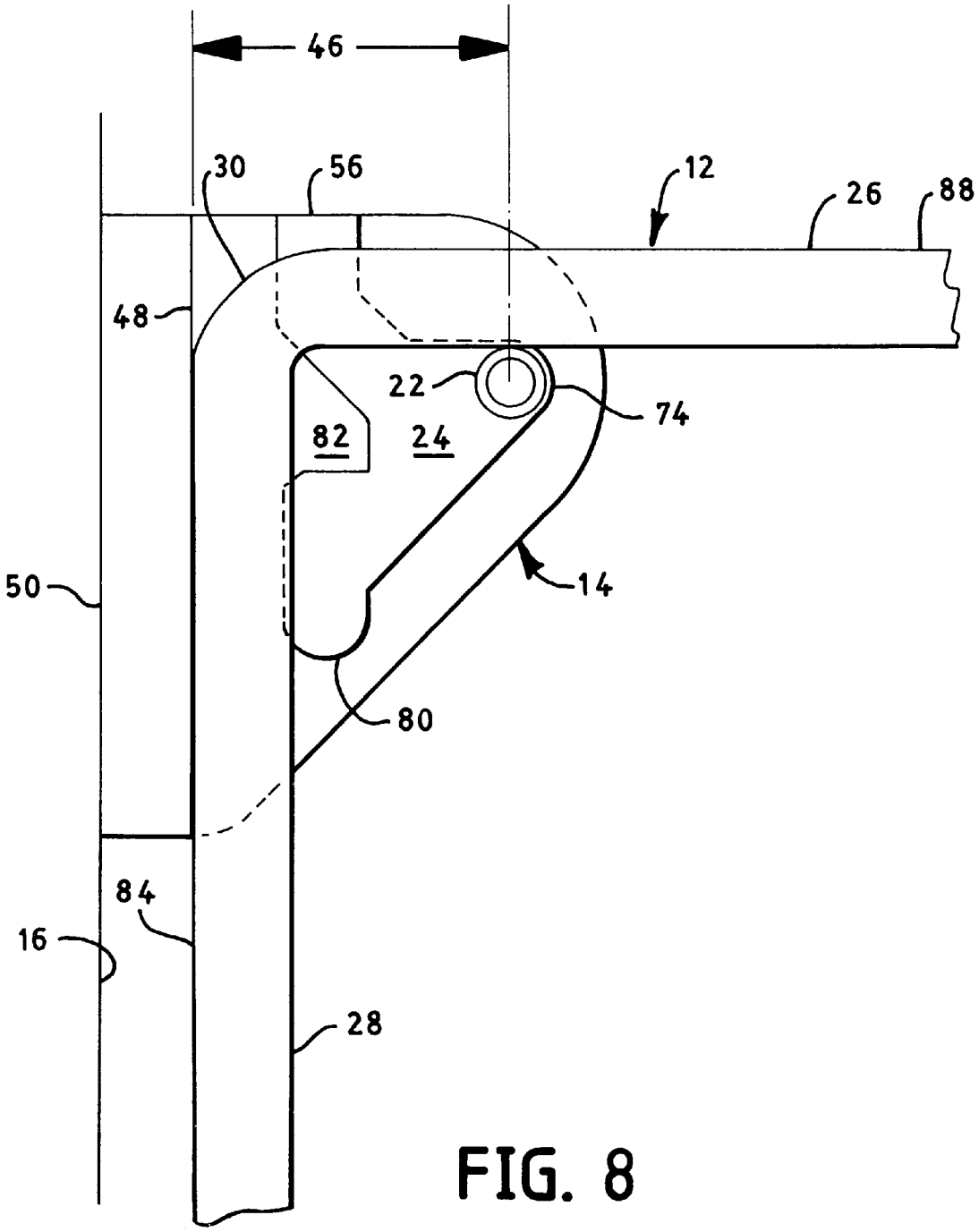
FIG. 8 is a perspective view of the shelf in the down position.

As indicated above, the platform 12 has a down position and an up position. In the down position, the upper panel 26 is horizontal, as shown in FIG. 8. It can be seen in FIG. 8 that the trunnion 22 is not at the corner 30 formed by the upper panel 26 and lower panel 28. It is located on the upper panel 26 at a distance 46 from the outer surface 84 of the lower panel 28 the such that, when the lower panel 28 is abutting the vertical retaining wall 48, the trunnion 22 resides in the 135° pocket 74 of the groove 24. Thus, platform 12 is retained in the down position by its own weight. Gravity pushes the trunnion 22 against the lower 45° portion of the front wall 76 and for gravity to cause the platform 12 to drop vertically, the trunnion 22 would have to slide rearwardly along the 45° front wall 76. However, the platform 12 is prevented from moving rearwardly by the lower panel 28 abutting the retaining wall 48. Thus, the platform 12 remains securely in the down position.

Figure 9:
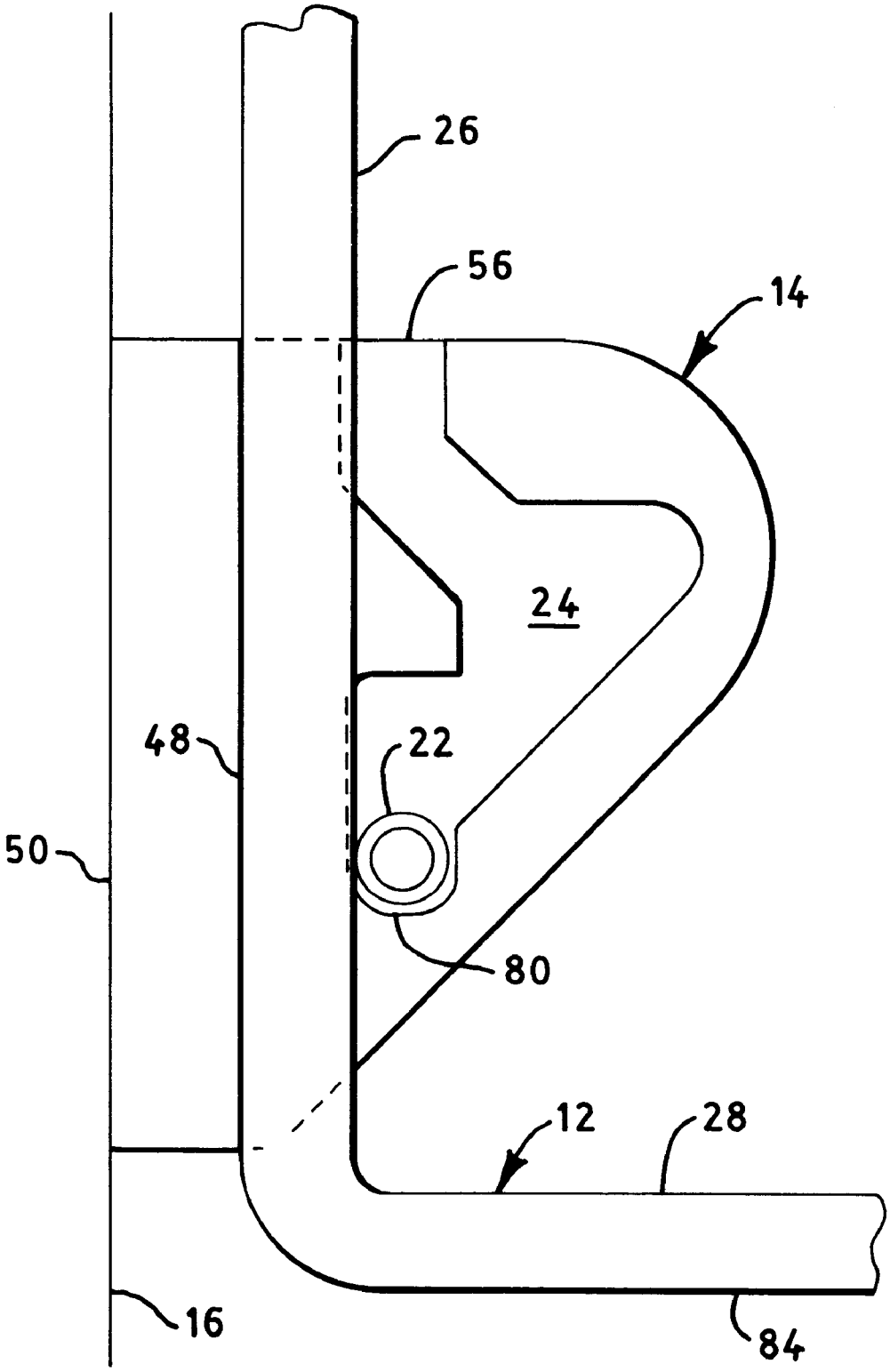
FIG. 9 is a perspective view of the shelf in the up position.

In the up position, the lower panel 28 is horizontal, as shown in FIG. 9. The trunnion 22 resides in the groove trough 80 and the outer surface 88 of the upper panel 26 abuts the retaining wall 48. The distance 86 from the trough 80 to the retaining wall 48 is the same as the distance from the trunnion 22 to the outer surface 88 of the upper panel 26. As with the down position, gravity maintains the platform 12 in the up position. The weight of the platform 12 causes it to try to rotate to the down position, which causes the portion of the upper panel 26 adjacent to the platform corner 30 to push against the retaining wall 48. This would cause the trunnion 22 to move out of the trough 80 and up the 45° front wall 76, except that the lower vertical portion of the front wall 78 prevents the trunnion 22 from exiting the trough 80. Thus the platform 12 remains securely in the up position. In order to prevent the trunnion 22 from leaving the trough 80, the vertical portion needs to be at least half the radius of the trunnion 22.

OPERATION

The platform 12 can be rotated between the up and down positions, installed into the brackets 14, and removed from the brackets 14. If the platform 12 is in the down position, it is rotated to the up position by lifting the outer edge of the upper panel 26 until the upper panel 26 is vertical, at which time the trunnions 22 will drop into the troughs 80. To return the platform 12 to the down position, lift the platform 12 so that the trunnions 22 are lifted above the lower vertical portion of the front wall 78, allowing the trunnions 22 to slide up the 45° portion of the front wall 76 to the pocket 74 and into the down position.

The platform 12 is typically heavy enough that once the upper panel 26 is several degrees from vertical, it will fall into the down position on its own and only needs to have its descent controlled.

The platform 12 is installed by holding the upper panel 26 in the vertical position, aligning the trunnions 22 with the groove openings 56, and dropping the trunnions 22 into the grooves 24. If the embodiment includes the dam 82, the trunnions 22 will slide down the 450 portion 62 and then fall into the troughs 80.

The manner in which the platform 12 is removed from the brackets 24 depends on whether the grooves 24 have dams 82 or not. If there are no dams 82, the platform 12 is rotated to the up position and merely lifted out of the groove 24. If there are dams 82, the platform 12 is rotated to the up position and then lifted up and around the dam 82 to reach the opening 56.

Thus it has been shown and described a detachable wall-mounted shelf which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A detachable shelf assembly comprising:

(a) a platform having (i) an upper panel and a lower panel attached at ends thereof to form an approximately 90° corner, said upper panel having an outer surface and said lower panel having an outer surface, and (ii) a coaxial pair of trunnions extending from said upper panel substantially parallel to and a distance from said corner, said trunnions having a radius;

(b) a pair of brackets, each of said brackets having a top surface, a retaining wall, and a groove, said groove of each bracket being a mirror image of the other;

(i) each of said grooves having a front wall and a back wall, each extending downwardly from said top surface, and an opening disposed therebetween, said opening having a width slightly larger than twice said trunnion radius;

(ii) said back wall extending vertically downwardly and terminating at a trough;

(iii) said front wall extending vertically downwardly from said top surface to a first bend extending away from said back wall, to a second bend extending away from said back wall, whereby an angle of approximately 90° is formed by said first and second bends; said second bend extends into a third bend extending towards said back wall through an angle of approximately 135°, said third bend defining a pocket; said third bend extends into a fourth bend extending away from said back wall through an angle of approximately 45° and approximately vertically into said trough by a distance of at least one half of said trunnion radius, said trough having a width slightly larger than twice said trunnion radius; and (iv) said retaining wall being parallel to at least a portion of said groove back wall, the distance from said retaining wall to said trough being substantially equal to the distance from one of said trunnions to said outer surface of said upper panel, and the distance from said retaining wall to said pocket being substantially equal to the distance from said one of said trunnions to said outer surface of said lower panel;

whereby when said platform is mounted to said brackets, said platform is movable between a first position and a second position, so that when said platform is in said first position, each of said trunnions is placed in a respective one of said pockets, said lower panel outer surface abuts said retaining wall, and said upper panel is maintained in a horizontal position; and when said platform is in said second position, each of said trunnions is placed in a respective one of said troughs, said upper panel outer surface abuts said retaining wall, and said upper panel is maintained in a vertical position, thereby allowing said platform to be detached from said brackets by lifting said trunnions out of said groove openings.

2. The detachable shelf assembly of claim 1 wherein said back wall extends vertically downwardly from said top surface to a first bend which extends approximately 45° away from said retaining wall; said first bend extends into a second bend which extends approximately 45° toward said retaining wall; said second bend extends into a third bend which extends toward said retaining wall; said third bend extends into a fourth bend which extends downwardly into said trough; said first, second, third, and fourth back wall bends forming a dam, whereby in order to detach said platform from said brackets, said trunnions are maneuvered around said dam.

3. The detachable shelf assembly of claim 1 wherein said trough is semicircular with a radius slightly larger than said trunnion radius.

4. The detachable shelf assembly of claim 1 wherein said pocket has a curve with a radius slightly larger than said trunnion radius.

5. A detachable shelf assembly comprising:

(a) a platform having (i) an upper panel and a lower panel attached at ends thereof to form an approximately 90° corner, said upper panel having an outer surface and said lower panel having an outer surface, and (ii) a coaxial pair of trunnions extending from said upper panel substantially parallel to and a distance from said corner, said trunnions having a radius;

(b) a pair of brackets, each of said brackets having a top surface, a retaining wall, and a groove, said groove of each bracket being a mirror image of the other;

(i) each of said grooves having a front wall and a back wall, each extending downwardly from said top surface, and an opening disposed therebetween, said opening having a width slightly larger than twice said trunnion radius;

(ii) said back wall extending vertically downwardly and terminating at a trough;

(iii) said front wall extending vertically downwardly from said top surface to a first bend extending away from said back wall, to a second bend extending away from said back wall, whereby an angle of approximately 90° is formed by said first and second bends; said second bend extends into a third bend extending towards said back wall through an angle of approximately 135°, said third bend defining a pocket having a radius slightly larger than said trunnion radius; said third bend extends into a fourth bend extending away from said back wall through an angle of approximately 45° and approximately vertically into said trough by a distance of at least one half of said trunnion radius, said trough being semicircular with a diameter slightly larger than twice said trunnion radius; and (iv) said retaining wall being parallel to at least a portion of said groove back wall, the distance from said retaining wall to said trough being substantially equal to the distance from one of said trunnions to said outer surface of said upper panel, and the distance from said retaining wall to said pocket being substantially equal to the distance from said one of said trunnions to said outer surface of said lower panel;

whereby when said platform is mounted to said brackets, said platform is movable between a first position and a second position, so that when said platform is in said first position, each of said trunnions is placed in a respective one of said pockets, said lower panel outer surface abuts said retaining wall, and said upper panel is maintained in a horizontal position; and when said platform is in said second position, each of said trunnions is placed in a respective one of said troughs, said upper panel outer surface abuts said retaining wall, and said upper panel is maintained in a vertical position, thereby allowing said platform to be detached from said brackets by lifting said trunnions out of said groove openings.

6. The detachable shelf assembly of claim 5 wherein said back wall extends vertically downwardly from said top surface to a first bend which extends approximately 45° away from said retaining wall; said first bend extends into a second bend which extends approximately 45° toward said retaining wall; said second bend extends into a third bend which extends toward said retaining wall; said third bend extends into a fourth bend which extends downwardly into said trough; said first, second, third, and fourth back wall bends forming a dam, whereby in order to detach said platform from said brackets, said trunnions are maneuvered around said dam.

* * * * *